US010618338B2

(12) United States Patent
Bastian

(10) Patent No.: US 10,618,338 B2
(45) Date of Patent: Apr. 14, 2020

(54) CONCEALMENT DEVICE

(71) Applicant: NNA Services, LLC, Chatsworth, CA (US)

(72) Inventor: Steven Bastian, Stevenson Ranch, CA (US)

(73) Assignee: NNA Services, LLC, Chatsworth, CA (US)

( * ) Notice: Subject to any disclaimer, the term of this patent is extended or adjusted under 35 U.S.C. 154(b) by 0 days.

(21) Appl. No.: 16/047,736

(22) Filed: Jul. 27, 2018

(65) Prior Publication Data

US 2020/0031156 A1 Jan. 30, 2020

(51) Int. Cl.
*B42D 13/00* (2006.01)
*B42D 9/00* (2006.01)

(52) U.S. Cl.
CPC ..... *B42D 13/00* (2013.01); *B42D 9/004* (2013.01); *B42D 9/008* (2013.01)

(58) Field of Classification Search
CPC ..... B42D 9/004; B42D 9/008; B42D 13/00
USPC ..... 281/3.1, 42; 116/235, 238, 239
See application file for complete search history.

(56) References Cited

U.S. PATENT DOCUMENTS 140,135 A * 6/1873 Hidreth ..... G09B 17/00 434/178
1,658,499 A * 2/1928 Stevens ..... B42D 9/008 281/42
2,195,646 A * 4/1940 Green ..... B42F 21/00 283/38
3,269,752 A * 8/1966 Lindaman ..... B42D 9/008 281/42
3,352,487 A * 11/1967 Olson ..... G06G 1/14 235/89 R
3,690,295 A * 9/1972 Cammack ..... B42D 9/008 116/235
3,739,739 A * 6/1973 Brase ..... B42D 9/008 281/42
4,186,683 A * 2/1980 LeRoy ..... B42D 9/007 281/42
6,582,546 B1 * 6/2003 Micek ..... B42D 5/003 156/249
7,946,552 B1 * 5/2011 St. Claire ..... B42D 9/00 248/441.1
7,954,444 B2 * 6/2011 Smith ..... B42D 9/008 116/235
2006/0108788 A1 * 5/2006 Hendrickson ..... B42D 5/003 281/42

* cited by examiner

*Primary Examiner* — Kyle R Grabowski
(74) *Attorney, Agent, or Firm* — Jeffrey G. Sheldon; Katherine B. Sales; Cislo & Thomas

(57) ABSTRACT

A concealment device comprising an opaque, removable, reusable sheet of static cling material sized to match up with a notary book having a plurality of pages, the sheet having an upper surface and a lower surface, the lower surface configured to secure to the notary book pages by static cling. A combination of a notary book having a plurality of pages and a concealment device comprising an opaque, removable, reusable sheet of static cling material sized to match up with the notary book, the sheet having an upper surface and a lower surface, the lower surface configured to secure to the notary book pages by static cling. A method of utilizing a notary book comprises the steps of providing a notary book and placing the concealment device thereon.

14 Claims, 5 Drawing Sheets

CONCEALMENT DEVICE

BACKGROUND

A notary public uses a notary journal to record notarized documents. Typical journal entries include the signer's name, address, driver's license information, title of the notarized document(s), and signature. If the information is not concealed, subsequent signers can have access to the personal information of previous signers. Shielding signers from this breach of privacy is therefore desirable.

U.S. Pat. No. 7,946,552 describes a privacy device that can be used to conceal personal information of previous signers. However, it is clumsy to use.

Accordingly, there is a need for an improved concealment device that conceals the personal information of previous signers from subsequent signers.

SUMMARY

In a first embodiment, the present invention is directed to a combination comprising: a) a notary book having a plurality of notary pages, each notary page comprising a plurality of notarization rows and a plurality of columns, including a bottom notarization row, each column having a top portion and a bottom portion, wherein the top portion of at least some of the columns has identification thereon; and b) a concealment device comprising an opaque, removable, reusable sheet of static cling material sufficiently wide to cover substantially the entire width of pages when the notary book is being signed and sufficiently tall to cover all of the notarization rows except the bottom notarization row, the sheet having: i) an upper surface and a lower surface, the lower surface configured to secure to the notary book pages by static cling; and ii) a top portion and a bottom portion, the bottom portion having a plurality of identifications that correspond with and align with the identifications on the notary book when the concealment device is placed on the open notary book.

In a second embodiment, the present invention is directed to a combination comprising: a) a notary book having a plurality of notary pages, each notary page comprising a plurality of columns; and b) a concealment device comprising an opaque, removable, reusable sheet of static cling material sized to match up with the pages of the notary book, the sheet having an upper surface and a lower surface, the lower surface configured to secure to the notary book pages by static cling.

In a third embodiment, the present invention is directed to a concealment device for use with a notary book comprising a plurality of pages having a plurality of notarization rows with confidential information thereon, the concealment device comprising: a) an opaque, removable, reusable sheet of static cling material sufficiently wide to cover the confidential information contained on the pages of a notary book when the notary book is being signed and having sufficient height to cover all of the notarization rows except a bottom notarization row, the sheet having: i) an upper surface and a lower surface, the lower surface configured to secure to the notary book pages by static cling; and ii) a top portion and a bottom portion, the bottom portion having a plurality of identifications that correspond with and align with identifications on the notary book when the concealment device is placed on the open notary book.

In any embodiment, the sheet can have a width of about 14 inches to about 20 inches and height of about 6 inches to about 8 inches, and the sheet can be made of a transparent or translucent material, and has a pattern on the upper surface of the sheet that renders the sheet opaque.

Optionally, the sheet can have sufficient height to cover all the notarization rows.

The sheet can be made from vinyl.

Optionally, the concealment device can further comprise a backing to which the concealment device is removably coupled.

Optionally, the concealment device can further comprise an anti-cling divider.

In a fourth embodiment, the present invention is directed to a method utilizing a notary book comprising the steps of: a) providing a notary book having a plurality of pages, each page having a plurality of rows and columns, at least one notarization row having confidential information thereon; and b) placing the concealment device onto the notary book to conceal notarization rows with confidential information thereon and leaving at least the lowest notarization row without information thereon uncovered, wherein a bottom portion of the concealment device has a plurality of identifications that correspond with and align with identifications on the notary book when the concealment device is placed on the open notary book.

In a fifth embodiment, the present invention is directed to a method of recording information about a person signing a document that is notarized, the method comprising the steps of: a) obtaining a notary book having a plurality of notary pages, each notary page comprising a plurality of notarization rows and a plurality of columns, including a bottom notarization row, each column having a top portion and a bottom portion, wherein the top portion of at least some of the columns has identification thereon; b) obtaining a concealment device comprising an opaque, removable, reusable sheet of static cling material sufficiently wide to cover substantially the entire width of pages when the notary book is being signed and sufficiently tall to cover all of the notarization rows except the bottom notarization row, the sheet having: i) an upper surface and a lower surface, the lower surface configured to secure to the notary book pages by static cling; and ii) a top portion and a bottom portion, the bottom portion having a plurality of identifications that correspond with and align with the identifications on the notary book when the concealment device is place on the open notary book; and c) placing the concealment device onto the notary book to conceal the notarization rows with information thereon and leaving the lowest notarization row without information thereon uncovered, wherein the concealment device is placed so that the identifications of the concealment device are aligned with the corresponding identifications of the notary book.

Optionally, the concealment device further comprises a backing to which the concealment device is adhered.

In a sixth embodiment, the present invention is a method of recording information about a person signing a document that is notarized, the method comprising the steps of: a) obtaining the combination of a notary book and a concealment device; b) removing the backing from the concealment device; c) placing the concealment device onto the notary book to conceal one or more upper rows with information thereon and leaving one or more lower rows without information thereon uncovered, wherein the concealment device is placed so that the identifications of the concealment device are aligned with the corresponding identifications of the notary book; d) having a person sign a non-concealed row; and e) repositioning the concealment device on the notary book to conceal the signed row.

Optionally, step e) comprises repositioning the concealment device on the notary book to conceal all signed notarization rows.

Optionally, before step e) and after step d), the method further comprises the step of placing a divider and then removing the divider.

DRAWINGS

These and other features, aspects, and advantages of the present invention will become better understood with reference to the following description, appended claims, and accompanying drawings where:

DESCRIPTION

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

Figure 1:
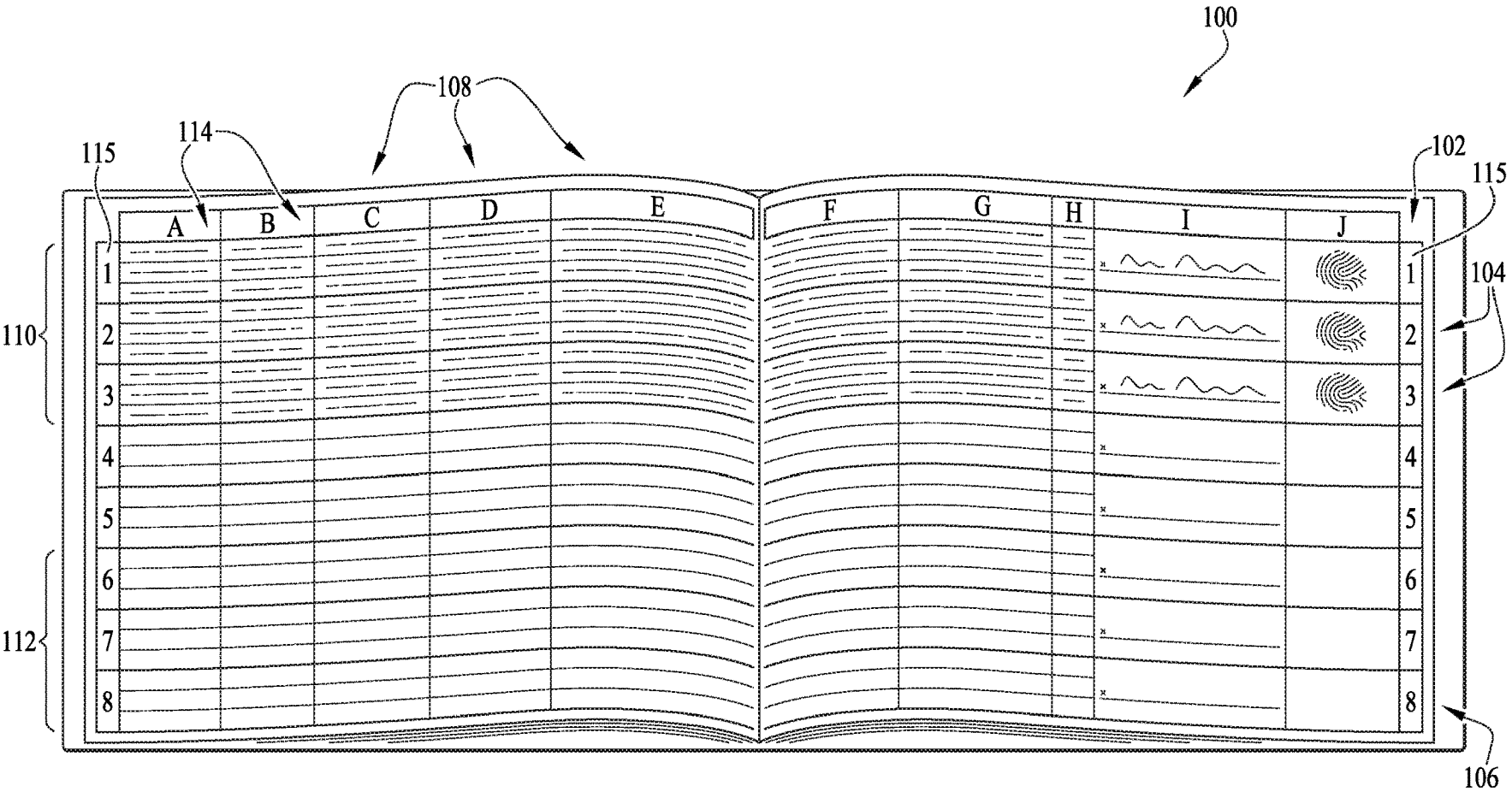
FIG. 1 PRIOR ART
FIG. 1 is a top plan view of a prior art notary book, wherein the top three lines have information contained therein.

Referring now to FIG. 1, there is shown a prior art notary book 100. The notary book 100 has a plurality of notary pages 102, each notary page 102 comprising a plurality of notarization rows 104, including a bottom row 106, and a plurality of columns 108. The term "notarization rows" refers to the rows where a person signs and other information is filled in. Each column 108 has a top portion 110 and a bottom portion 112, wherein the top portion 110 of at least some of the columns 108 has identification 114 thereon. Examples of the identification 114 are titles for each column 108 identifying the contents of the column 108, the contents being one or more or any combination of the following: the date and time the notarization took place, the type of notarization performed—such as, "Acknowledgment" or "Jurat," the type of document being notarized—for example "Deed of Trust" or "Power of Attorney," the signature or mark of each person whose signature or mark is notarized, as well as the signature of any subscribing witness, what type of satisfactory evidence was used to identify the signer, such as "U.S. Passport, the fee charged for the notarial act, and a thumbprint of the signer. Thus notary books 100 contain personal information of people that have signed it. This personal information must be concealed from other people that subsequently sign the notary pages 102. Additionally, the notary book 100 can also comprise row identification numbers 115 disposed along each outside edge of each page 102.

Figure 2:
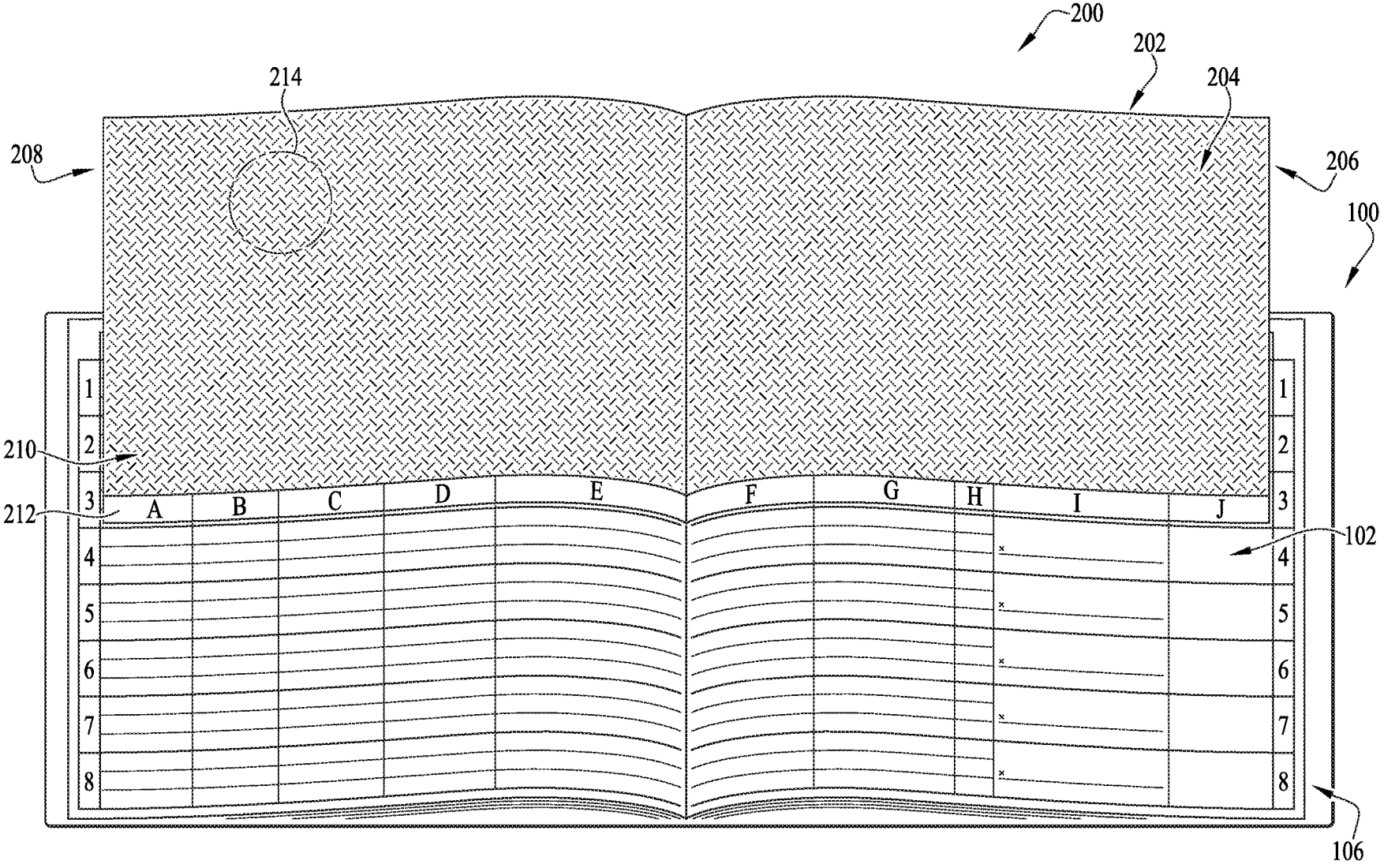
FIG. 2 is a top plan view of a first embodiment of a concealment device having features of the present invention, wherein the concealment device is oriented in landscape mode and is placed on the notary book of FIG. 1 to conceal the top three lines of information and reveal the bottom five lines for entry of information.
Figure 3:
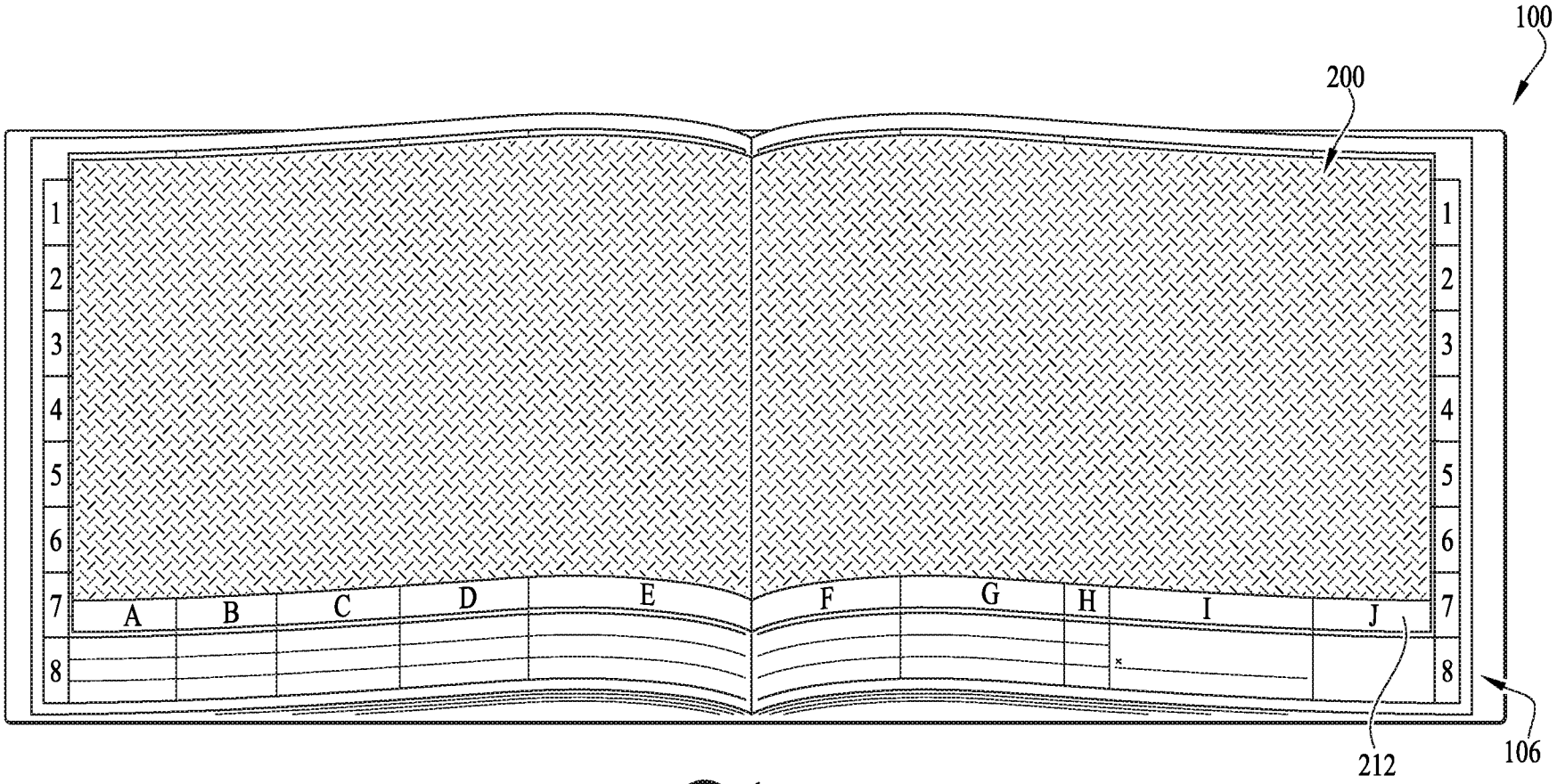
FIG. 3 is a top plan view of the concealment device of FIG. 2, wherein the concealment device is placed on the notary book of FIG. 1 to conceal the top seven lines of information and reveal the last line for entry of information.

Referring now to FIGS. 2 and 3, there is shown the combination of the prior art notary book 100 and a concealment device 200. The concealment device 200 is an opaque, removable, reusable sheet 202 of static cling material that is sufficiently wide to cover substantially the entire width of the notary book pages 102 when the notary book 100 is being signed and sufficiently long to cover at least all the length of the notary book page 102 except the bottom row 106.

The sheet 202 has an upper surface 204, a lower surface 206, a top portion 208 and a bottom portion 210. In use, the lower surface 206 of the sheet 202 is configured to secure to the notary book pages 102 by static cling. The sheet 202 is typically provided with a backing 500 (see FIG. 5) comprising a smooth non-porous surface, the backing 500 having substantially the same width and height of the sheet 202. The backing 500 can be made from a 10 pt. cast coated board stock. An example of an acceptable backing is sold under the trademark Kromekote®, available from CTI Paper, having a place of business in Sun Prairie, Wis. The sheet 202 is electrostatically adhered to the backing 500 and prior to use, the sheet 202 is adapted to be manually peeled from the backing 500 and electro-statically selectively adhered any number of times to notary book pages 102.

Optionally, the bottom portion 210 of the sheet 202 has a plurality of identifications 212 that correspond with and align with the identifications 114 on the notary book pages 102 when the concealment device 200 is placed on the open notary book 100. The identifications 212 on the bottom portion 210 of the sheet 202 are useful because when the sheet 202 is placed on the notary book pages 102, not only does the sheet 202 conceal the personal information beneath it, but the sheet 202 also conceals the titles (or identifications 114) of the columns 108 on the notary book pages 102. This makes it difficult to fill in the columns when the signer cannot tell what the contents should be.

The sheet 202 can be made from vinyl such as polyvinylchloride, or low-density polyethylene. An example of an acceptable vinyl is sold under the trademark Hi Stat®, available from Catalina Graphic Films, having a place of business in Las Vegas, Nev.

The minimum height of the sheet 202 is sufficient to at least cover all of the notarization rows 104 of the notary book 100 except the bottom row 106. The sheet 202 can have a greater height, but there is no reason for the extra height. The sheet 202 need not cover the identification material 114 at the top of the page 102. Thus the minimum height of the sheet 202 is equivalent to the height of all the notarization rows 104 to be filled in except for the bottom notarization row 106.

Additionally, the minimum width of the sheet 202 is sufficient to at least cover all of the information contained in the notarization rows 104. The sheet 202 can have a greater width, but there is no reason for the extra width. The sheet 202 need not cover the row identification numbers 115 disposed along the outside edges of the pages 102. Thus, the minimum width of the sheet 202 is equivalent to the width of the all the notarization rows 104 to be filled in except the row identification numbers 115.

The sheet 202 can have a width of about 10 inches to about 23 inches and height of about 5 inches to about 10 inches. Preferably, the sheet 202 has a width of about 20.5 inches and a height of about 6.6 inches for landscape-oriented notary books 100, and a width of about 14.8 inches and a height of about 8 inches for portrait-oriented notary books 400. The sheet 202 can have a thickness of about 7.5 mils plus or minus 0.2 mils.

The sheet 202 conceals the information on the notary book pages 102 when the sheet 202 is in place. Therefore, the sheet 202 can be opaque, which can be achieved by addition of a colorant to the sheet material when it is being formed, by applying a pattern to the upper surface 204 of the sheet 202, or by applying colorant to the sheet 202 such as by printing, or a combination of two or three of the foregoing. Alternatively, the sheet 202 is not opaque but has a pattern 214 applied or printed onto the upper surface 204 of the sheet 202 so the information below the sheet 202 is concealed.

The sheet 202 is removable and reusable which is achieved by utilizing static cling. The use of static cling is an effective way to secure the sheet 202 to the pages 102, without permanently coupling the sheet 202 to the pages 102, or damaging the pages 102.

In use, a notary book 100 has personal information written into its notarization rows 104 (see FIG. 1). In order to prevent subsequent signers from viewing the personal information provided by previous signers, the concealment device 200 is applied to the notary book pages 102. As shown in FIG. 2, the concealment device 200 is only applied to cover the rows 104 already containing personal information. The blank rows 104 on the notary book page 102 are left revealed. As subsequent signers sign the notary book pages 102, and additional rows 104 contain personal information, the concealment device is moved down the notary book page 102, continuing to conceal the information provided by previous signers. Ultimately, as shown in FIG. 3, when the concealment device 200 is applied completely, only the last row 106 is left revealed. When the last row 106 contains personal information thereon, the concealment device 200 is removed from the pages 102, and the pages 102 are turned, revealing blank pages 102 for signing. The concealment device 200 can be reapplied to the blank pages 102 once they contain personal information that must be concealed from subsequent signers.

Figure 4:
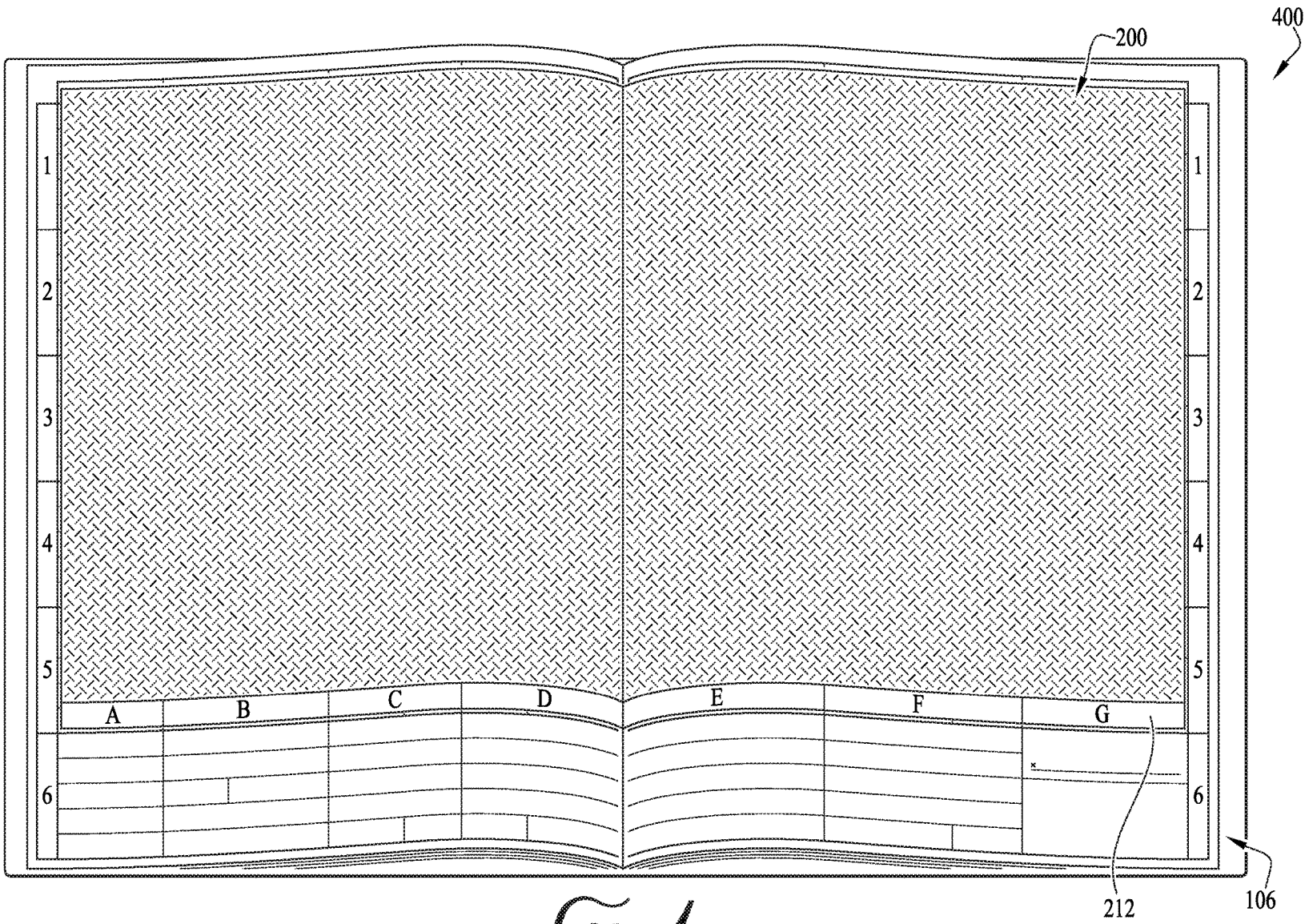
FIG. 4 is a top plan view of a second embodiment of a concealment device having features of the present invention, wherein the conceal device is oriented in portrait mode.

Most notary books 100 are in the landscape orientation, as shown in FIGS. 1-3. Hawaii requires its notary books 400 to be in the portrait orientation, as shown in FIG. 4. The last row 106 still remains revealed when the concealment device 200 is fully applied to the notary book 400.

Figure 5:
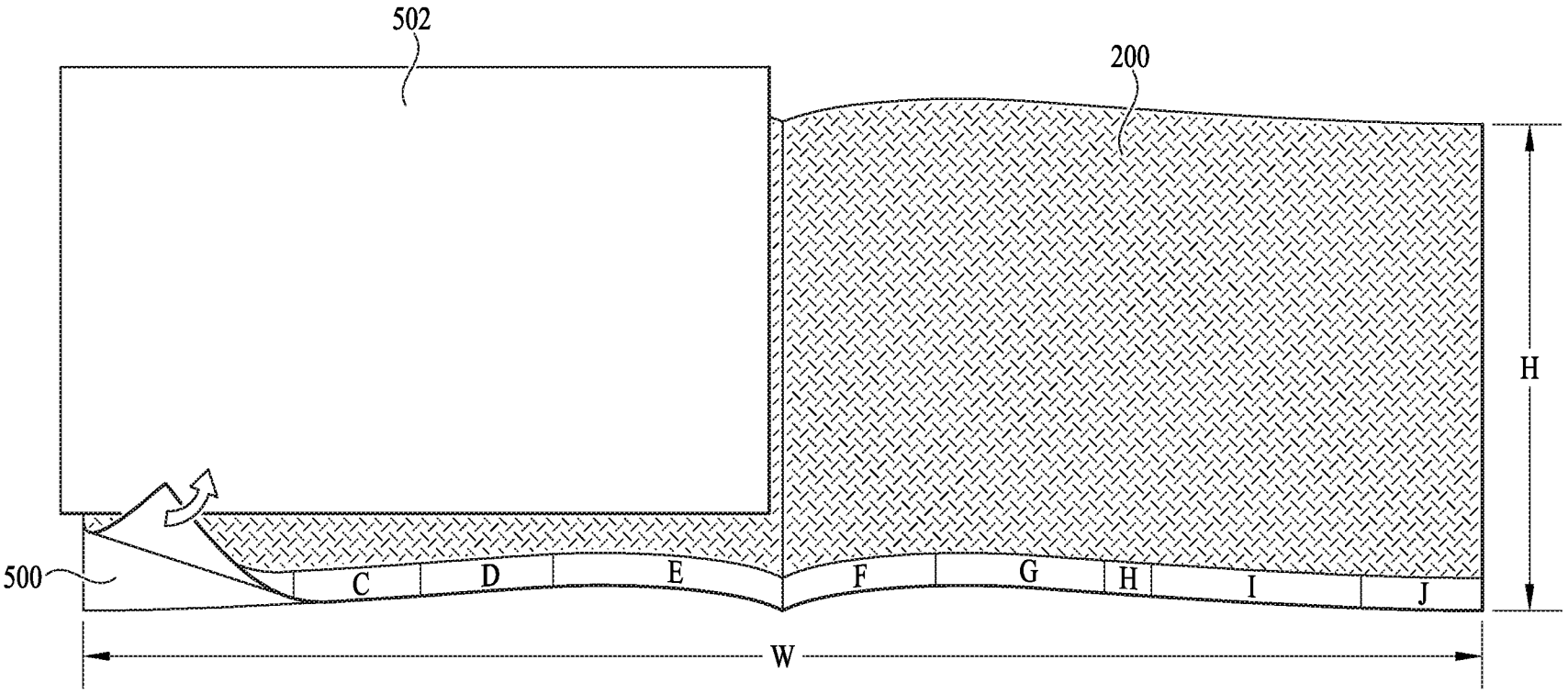
FIG. 5 is a top plan view of the concealment device of FIG. 2, wherein the sheet is peeled away from the backing, and the concealment device further comprises an anti-cling divider.

Referring now to FIG. 5, there is shown the concealment device 200 with an anti-cling divider 502. The divider 502 is placed in the middle of the concealment device 200, so that when the notary book 100 (and concealment device 200 contained therein) is folded closed, the divider 502 prevents the concealment device 200 from clinging to itself upon reopening of the notary book 100.

The invention also comprises a method utilizing a notary book. The method comprises the steps of:

a) providing a notary book 100 having a plurality of pages 102, each page 102 having a plurality of rows 104 and columns 108, at least one row 104 having information thereon; and b) placing the concealment device 200 onto the notary book 100 to conceal rows 104 with information thereon and leaving the lowest row 106 without information thereon uncovered.

The invention also comprises a method of recording information about a person signing a document that is notarized. The method comprises the steps of:

a) obtaining the combination of a notary book 100 and the concealment device 200; and b) placing the concealment device 200 onto the notary book 100 to conceal rows 104 with information thereon and leaving the lowest row 106 without information thereon uncovered, wherein the concealment device 200 is placed so that the identifications 212 of the concealment device 200 are aligned with the corresponding identifications 114 of the notary book 100.

The invention also comprises a method of recording information about a person signing a document that is notarized. The method comprises the steps of:

a) obtaining the combination of a notary book 100 and a concealment device 200;

b) removing the backing 500 from the concealment device 200;

c) placing the concealment device 200 onto the notary book 100 to conceal one or more upper rows 104 with information thereon and leaving one or more lower rows 106 without information thereon uncovered, wherein the concealment device 200 is placed so that the identifications 212 of the concealment device 200 are aligned with the corresponding identifications 114 of the notary book 100;

d) having a person sign a non-concealed row; and e) repositioning the concealment device 200 on the notary book 100 to conceal the signed row 104.

Optionally, step e) can comprise repositioning the concealment device 200 on the notary book 100 to conceal all signed notarization rows 104.

Optionally, before step e) and after step d), the method further comprises the step of placing a divider 502 and then removing the divider 502.

Various versions of the present invention have one or more of the following advantages compared to other notary book concealment devices:

1) Due to the use of static cling, the concealment device 200 stays in place so that when the notary book 100, 400 is moved, i.e. slid towards the signer for signing, the entries of previous signers do not accidentally get uncovered 2) The concealment device 200 is easier to place—due to the use of static cling, the concealment device 200 is simply laid on the pages 102 and automatically clings to the pages 102.

Also the device 200 can be used as a bookmark for the notary so the notary knows where in the book to go for the next signature.

Although the invention has been described in terms of a preferred embodiment, nevertheless, changes and modifications can be made which do not depart from the spirit, scope and teachings of the invention. Such changes and modifications are deemed to fall within the purview of the present invention as claimed.

What is claimed is:

1. A combination comprising:

a) a notary book having a plurality of notary pages, each notary page comprising a plurality of notarization rows and a plurality of columns, including a bottom notarization row, each column having a top portion and a bottom portion, wherein the top portion of at least some of the columns has identification thereon; and b) a concealment device comprising an opaque, removable, reusable sheet of static cling material sufficiently wide to cover substantially the entire width of pages when the notary book is being signed and sufficiently tall to cover all of the notarization rows except the bottom notarization row, the sheet having:

i) an upper surface and a lower surface, the lower surface configured to secure to the notary book pages by static cling; and ii) a top portion and a bottom portion, the bottom portion having a plurality of identifications that correspond with and align with the identifications on the notary book when the concealment device is placed on the open notary book.

2. The combination of claim 1, wherein the sheet has a width of about 14 inches to about 20 inches and height of about 6 inches to about 8 inches.

3. The combination of claim 1, wherein the sheet is made of a transparent or translucent material, and has a pattern on the upper surface of the sheet that renders the sheet opaque.

4. The combination of claim 1, wherein the sheet is made from vinyl.

5. The combination of claim 1, further comprising a backing to which the sheet is removably coupled.

6. The combination of claim 1, further comprising an anti-cling divider.

7. The combination of claim 1, wherein the concealment device further comprises a backing to which the sheet is adhered.

8. A method of recording information about a person signing a document that is notarized, the method comprising the steps of:

a) obtaining a notary book having a plurality of notary pages, each notary page comprising a plurality of notarization rows and a plurality of columns, including a bottom notarization row, each column having a top portion and a bottom portion, wherein the top portion of at least some of the columns has identification thereon;

b) obtaining a concealment device comprising an opaque, removable, reusable sheet of static cling material sufficiently wide to cover substantially the entire width of pages when the notary book is being signed and sufficiently tall to cover all of the notarization rows except the bottom notarization row, the sheet having:

i) an upper surface and a lower surface, the lower surface configured to secure to the notary book pages by static cling; and ii) a top portion and a bottom portion, the bottom portion having a plurality of identifications that correspond with and align with the identifications on the notary book when the concealment device is place on the open notary book; and c) placing the concealment device onto the notary book to conceal the notarization rows with information thereon and leaving the lowest notarization row without information thereon uncovered, wherein the concealment device is placed so that the identifications of the concealment device are aligned with the corresponding identifications of the notary book.

9. The method of claim 8, wherein the concealment device sheet of step b) has a width of about 14 inches to about 20 inches and height of about 6 inches to about 8 inches.

10. The method of claim 8, wherein the concealment device sheet of step b) is made of a transparent or translucent material, and has a pattern on the upper surface of the sheet that renders the sheet.

11. The method of claim 8, wherein the concealment device sheet of step b) is made from vinyl.

12. The method of claim 6, wherein the concealment device of step b) further comprises a backing to which the sheet is removably coupled.

13. The method of claim 8, wherein the concealment device of step b) further comprises an anti-cling divider.

14. A combination comprising:

a) a notary book having a plurality of notary pages, each notary page comprising a plurality of notarization rows and a plurality of columns, including a bottom notarization row, each column having a top portion and a bottom portion, wherein the top portion of at least some of the columns has identification thereon; and b) a concealment device comprising an opaque, removable, reusable sheet of static cling material sufficiently wide to cover substantially the entire width of pages when the notary book is being signed and sufficiently tall to cover all of the notarization rows except the bottom notarization row, the sheet having:

i) an upper surface and a lower surface, the lower surface configured to secure to the notary book pages by static cling;

ii) a top portion and a bottom portion, the bottom portion having a plurality of identifications that correspond with and align with the identifications on the notary book when the concealment device is placed on the open notary book; and iii) a backing to which the sheet is adhered;

wherein the sheet has a width of about 14 inches to about 20 inches and height of about 6 inches to about 8 inches and is made of a transparent or translucent vinyl, and has a pattern on the upper surface of the sheet that renders the sheet opaque.

* * * * *